United States Patent [19]

Harris

[11] 4,124,259

[45] Nov. 7, 1978

[54] TOILET PAPER HOLDER

[76] Inventor: Betty J. Harris, 1721 Ferry St., Anderson, Calif. 96007

[21] Appl. No.: 802,993

[22] Filed: Jun. 2, 1977

[51] Int. Cl.[2] ..... B65H 19/00

[52] U.S. Cl. ..... 312/39; 242/55.53

[58] Field of Search ..... 312/39, 38, 37, 71; 242/55.2, 55.3, 55.53; D19/89, 86, 52

[56] References Cited

U.S. PATENT DOCUMENTS

| | | | |
|---|---|---|---|
| 81,737 | 5/1943 | Schiff | 242/55.3 |
| 2,299,736 | 10/1942 | Cavoto | 242/55.3 |
| 2,459,252 | 1/1949 | Strahan | 242/55.53 |
| 2,482,714 | 9/1949 | Mell | 312/39 |
| 3,039,709 | 6/1962 | Bolger | 242/55.3 |
| 3,211,504 | 10/1965 | Bump | 242/55.3 |
| 3,239,158 | 3/1966 | Levesque | 242/55.53 |
| 3,362,653 | 1/1968 | Carlisle | 242/55.2 |
| 3,467,330 | 9/1969 | Yavitch | 242/55.53 |
| 3,754,804 | 8/1973 | Cushman | 312/39 |

*Primary Examiner*—Victor N. Sakran
*Attorney, Agent, or Firm*—Daniel Jay Tick

[57] ABSTRACT

A toilet paper holder constitutes a free-standing portable cabinet with half disc-shaped projections extending from the front edges of the sides. A roll of toilet paper is rotatably mounted between the projections. The cabinet stores spare rolls of toilet paper and is closed by a hinged door.

2 Claims, 3 Drawing Figures

TOILET PAPER HOLDER

BACKGROUND OF THE INVENTION

The present invention relates to a toilet paper holder.

The toilet paper holder of the invention is free-standing and portable, and permits the positioning of the toilet paper anywhere it is desired in a bathroom at any location, not necessarily next to a wall. Furthermore, when the toilet paper holder of the invention has a height of approximately 24 inches, the top of the cabinet may be used for conveniently holding either an ash tray, a plant, or the like. The lightness of weight of the toilet paper holder of the invention permits its movement to either side of the toilet to meet the needs of both right-handed and left-handed users. The toilet paper holder of the invention is also positionable in a toilet at a correct distance from the toilet for convenient finger tip reach of the toilet paper. The toilet paper holder may be positioned at any desired location adjacent the toilet.

BRIEF DESCRIPTION OF THE DRAWINGS:

In order that the invention may be readily carried into effect, it will now be described with reference to the accompanying drawings, wherein.

DETAILED DESCRIPTION OF THE INVENTION

Figure 1:
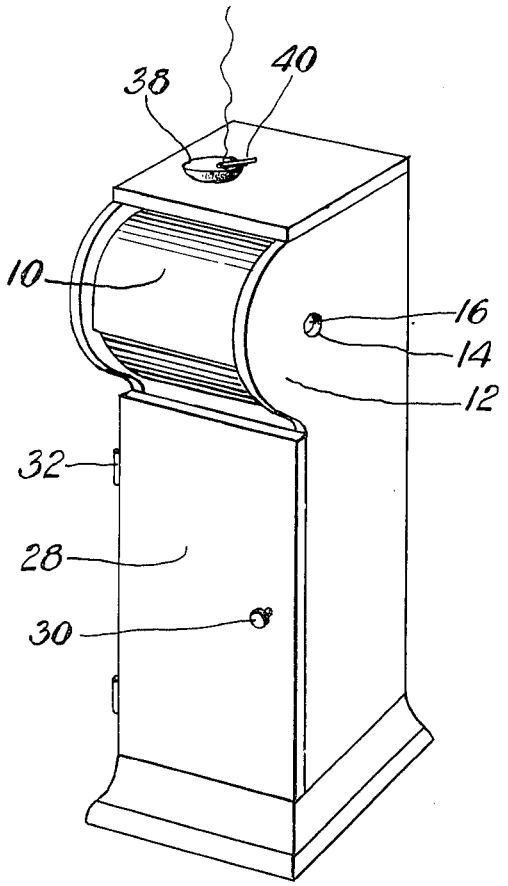
FIG. 1 is a perspective view of an embodiment of the toilet paper holder of the invention.
Figure 2:
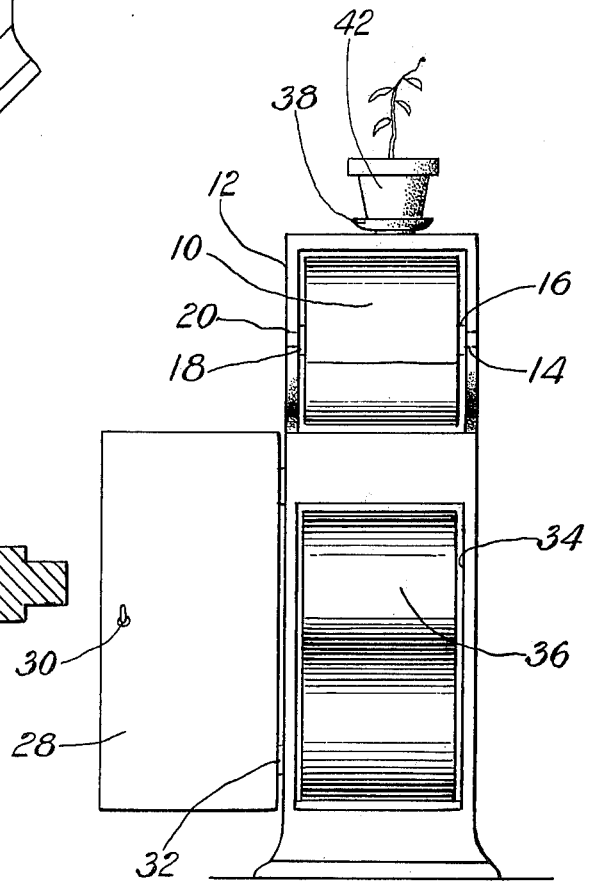
FIG. 2 is a front view of the embodiment of FIG. 1 with the door open.

The toilet paper holder of the invention comprises a free-standing portable cabinet 12 having a substantially rectangular base member resting on a floor (FIGS. 1 and 2). The cabinet 12 has a pair of spaced parallel substantially rectangular sides extending perpendicularly upward from the base member. Each of the sides has a front edge and a top part having a substantially half disc-shaped projection, as shown in FIG. 1, extending from the front edge with an aperture formed through the axial center of the projection. The aperture 14 formed through the projection of the right side is shown in FIGS. 1 and 2 and the aperture 20 formed through the projection of the left side is shown in FIG. 2.

As clearly seen in FIG. 1, each of the sides is of substantially P-like configuration.

The cabinet 12 has an open front 34 (FIG. 2) extending between the front edges of the sides and the base member, and a back perpendicular to the sides and the base member. The cabinet 12 has a top perpendicular to the sides and back (FIGS. 1 and 2), on which any desired item such as, for example, an ashtray 38 (FIG. 1) and/or flower pot 42 (FIG. 2) may be placed. The ashtray 38 provides a safe receptacle for a lighted cigarette 40, as shown in FIG. 1.

A door 28 having a knob 30 (FIGS. 1 and 2) is hingedly affixed to the left side via suitable hinges 32 (FIGS. 1 and 2) for selectively opening and closing the open front 34 from the base member to a line beneath the projections of the sides and parallel to the top of the cabinet 12. The cabinet 12 thus provides a closable storage space for spare rolls of toilet paper 36 (FIG. 2).

Figure 3:
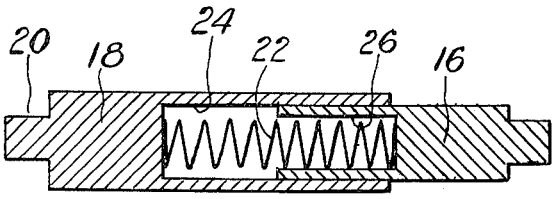
FIG. 3 is a cross-sectional view, on an enlarged scale, of an embodiment of a roller utilizable with the embodiment of FIG. 1.

A roller 16, 18 is rotatably mounted in the apertures 14 and 20, respectively, of the projections of the right and left sides, respectively, of the cabinet and extends perpendicularly between said projections. The roller 16, 18 comprises a hollow shaft 16 having a shaftway 26 coaxially slidably mounted in a hollow shaft 18 having a shaftway 24 of greater diameter than the shaftway 26 (FIG. 3). A spring 22 is positioned in the shaftways 24 and 26 and urges the shafts 16 and 18 away from each other in axial directions, as shown in FIG. 3. The shafts 16 and 18 are manually movable toward each other, in axial directions, to compress the spring 22, and permit the insertion of the roller 16, 18 into the apertures 14 and 20 and the removal of said roller from said apertures thereby permitting the replacement of a roll of toilet paper 10 rotatably mounted on said roller.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A toilet paper holder comprising a free-standing portable cabinet having a substantially rectangular base member resting on a floor, a pair of spaced parallel substantially rectangular sides extending perpendicularly upward from the base member, each of the sides having a front edge and a top part having a substantially half disc-shaped projection extending from the front edge with an aperture formed through the axial center of said projection, an open front extending between the front edges of the sides and the base member, a back perpendicular to the sides and the base member and a top perpendicular to the sides and the back;

a door hingedly affixed to one of the sides for selectively opening and closing the open front from the base member to a line beneath the projections of the sides and parallel to the top of the cabinet thereby providing a closable storage space in the cabinet for spare rolls of toilet paper;

a roller rotatably mounted in the apertures of the projections of the sides and extending perpendicularly between said projections; and a roll of toilet paper rotatably mounted on the roller between the projections of the sides.

2. A toilet paper holder as claimed in claim 1, wherein each of said sides is of substantially P-like configuration.

* * * * *